US006712866B2

(12) United States Patent
Paul

(10) Patent No.: US 6,712,866 B2
(45) Date of Patent: Mar. 30, 2004

(54) ALTERNATIVE FUEL

(75) Inventor: Stephen F. Paul, Princeton, NJ (US)

(73) Assignee: Stephen Paul, West Orange, NJ (US)

( * ) Notice: Subject to any disclaimer, the term of this patent is extended or adjusted under 35 U.S.C. 154(b) by 0 days.

(21) Appl. No.: 09/961,752

(22) Filed: Sep. 24, 2001

(65) Prior Publication Data

US 2002/0035802 A1 Mar. 28, 2002

Related U.S. Application Data

(63) Continuation of application No. 09/180,246, filed as application No. PCT/US97/07347 on May 1, 1997, now Pat. No. 6,309,430, which is a continuation-in-part of application No. 08/644,907, filed on May 10, 1996, now Pat. No. 5,697,987.

(51) Int. Cl.[7] ..... C10L 1/18
(52) U.S. Cl. ..... 44/352; 44/451; 44/452
(58) Field of Search ..... 44/352, 451, 452, 44/350, 446

(56) References Cited

U.S. PATENT DOCUMENTS

| | | | | | |
|---|---|---|---|---|---|
| 2,104,021 | A | | 1/1938 | Callis | 44/446 |
| 2,321,311 | A | | 6/1943 | Mottlau et al. | 44/352 |
| 2,725,344 | A | | 11/1955 | Fenske et al. | 44/352 |
| 3,857,859 | A | | 12/1974 | Tumolo | 260/346.1 |
| 3,869,262 | A | * | 3/1975 | Mayerhoffer et al. | 44/402 |
| 3,909,216 | A | | 9/1975 | Stearns et al. | 44/352 |
| 4,191,536 | A | | 3/1980 | Niebylski | 44/352 |
| 4,207,077 | A | | 6/1980 | Bone et al. | 44/446 |
| 4,261,702 | A | * | 4/1981 | Sweeney et al. | 44/402 |
| 4,276,055 | A | * | 6/1981 | Huang | 44/438 |
| 4,390,344 | A | * | 6/1983 | Sweeney | 44/444 |
| 4,451,266 | A | * | 5/1984 | Barclay et al. | 44/308 |
| 4,603,662 | A | | 8/1986 | Norton et al. | 44/352 |
| 4,806,129 | A | | 2/1989 | Dorn et al. | 44/56 |
| 4,897,497 | A | | 1/1990 | Fitzpatrick | 549/489 |
| 5,004,850 | A | | 4/1991 | Wilson | 585/1 |
| 5,093,533 | A | | 3/1992 | Wilson | 585/1 |
| 5,515,280 | A | | 5/1996 | Suzuki | 44/352 |
| 5,697,987 | A | | 12/1997 | Paul | 44/352 |
| 6,309,430 | B1 | * | 10/2001 | Paul | 44/352 |
| 2001/0034966 | A1 | * | 11/2001 | Golubkov et al. | 44/329 |

FOREIGN PATENT DOCUMENTS

| | | |
|---|---|---|
| DE | 30 16 481 A | 11/1981 |
| JP | 58-174492 | 10/1983 |
| JP | 1-259091 | 10/1989 |
| WO | WO 97/43356 | 11/1997 |

OTHER PUBLICATIONS

Fitzpatrick, "MTHF: A Important New Development for Reformulated Gasoline.".

Fitzpatrick, "Ethanol Market Development Challenges—New Feedstocks and Formulations", *Governors*[1] *Ethanol Coalition Presentation*, Feb. 16, 1995.

Lucas et al., "Exhaust Emissions and Field Trial Results of a New, Oxygenated, Non–Petroleum–Based, Waste–Derived Gasoline Blending Component: 2–Methyltetrahydrofuran", SAE Technical Paper Series 932675, Oct. 18, 1993.

Rudolph et al., "$NO_x$, NMHC and CO Emissions from Biomass Derived Gasoline Extenders", Biomass, 16, 33–49 (1988).

Wallington et al., "The Atmospheric Reactivity of α–Methyltetrahydrofuran", *Environ, Sco. Technol*, 24, 1596–99 (1990).

Thomas et al., "Biomass Derived Levulinic Acid Derivatives and Their Use as Liquid Fuel Extenders", *Biomass Energy Dev.* [*Proc, South Biomass Energy Res. Conf.*], *3rd*, Smith, Editor; Plenum, New York, 1986, 333–48 (1985 Meeting Date).

Written Opinion dated Feb. 9, 1998, in PCT/US97/07347.

International Preliminary Examination Report dated Jun. 16, 1998, in PCT/US97/07347.

Examination Report dated Nov. 30, 2000, in South Korean Application No. 98–709062, and English–language translation thereof.

* cited by examiner

*Primary Examiner*—Margaret B. Medley
(74) *Attorney, Agent, or Firm*—Synnestvedt & Lechner LLP

(57) ABSTRACT

A spark ignition motor fuel composition consisting essentially of: a hydrocarbon component containing one or more hydrocarbons selected from five to eight carbon atoms straight-chained or branched alkanes, wherein the hydrocarbon component has a minimum anti-knock index of 65 as measured by ASTM D-2699 and D-2700 and a maximum dry vapor pressure equivalent (DVPE) of 15 psi (one atmosphere (atm.)) as measured by ASTM D-5191; a fuel grade alcohol; and a co-solvent for the hydrocarbon component and the fuel grade alcohol; wherein the hydrocarbon component, the fuel grade alcohol and the co-solvent are present in amounts selected to provide a motor fuel with a minimum anti-knock index of 87 as measured by ASTM D-2699 and D-2700, and a maximum DVPE of 15 psi (1 atm.) as measured by ASTM D-5191, and wherein the fuel composition is essentially free of olefins, aromatics, and sulfur. A method for lowering the vapor pressure of a hydrocarbon-alcohol blend by adding a co-solvent for the hydrocarbon and the alcohol to the blend is also disclosed.

12 Claims, No Drawings

ALTERNATIVE FUEL

CROSS-REFERENCE To RELATED APPLICATIONS

This is a continuation of U.S. patent application Ser. No. 09/180,246 filed May 3, 1999, now U.S. Pat. No. 6,309,430 which is the U.S. national phase of International Application No. PCT/US97/07347 filed May 1, 1997, which is a continuation-in-part of U.S. patent application Ser. No. 08/644,907 filed May 10, 1996, now U.S. Pat. No. 5,697,987 issued Dec. 16, 1997. The disclosures of these related applications are incorporated herein by reference.

BACKGROUND OF THE INVENTION

The present invention relates to spark ignition motor fuel compositions based on liquid hydrocarbons derived from biogenic gases that are blended with a fuel grade alcohol and a co-solvent for the liquid hydrocarbon and the alcohol, and having an anti-knock index, a heat content, and a Dry Vapor Pressure Equivalent (DVPE) effective to fuel a spark ignition internal combustion engine with minor modifications. In particular, the present invention relates to Coal Gas Liquid (CGL) or Natural Gas Liquids (NGLs)-ethanol blends in which the co-solvent is biomass-derived 2-methyltetrahydrofuran (MTHF).

A need exists for alternatives to gasoline motor fuels for spark ignition internal combustion engines. Gasoline is derived from the extracting of crude oil from oil reservoirs. Crude oil is a mixture of hydrocarbons that exist in liquid phase in underground reservoirs and remains liquid at atmospheric pressure. The refining of crude oil to create conventional gasoline involves the distillation and separation of crude oil components, gasoline being the light naptha component.

Only ten percent of the world reserves of crude oil lie in the United States, with an overwhelming majority of the remaining 90 percent located outside the boundaries, not only of the United States, but also its North American free trade partners. Over 50 percent of conventional gasoline is imported, with this number to increase steadily into the next century.

Conventional gasoline is a complex composite of over 300 chemicals, including napthas, olefins, alkenes, aromatics and other relatively volatile hydrocarbons, with or without small quantities of additives blended for use in spark ignition engines. The amount of benzene in regular gasoline can range up to 3–5 percent, and the amount of sulfur to 500 ppm. Reformulated gasoline (RFG) limits the quantity of sulfur to 330 ppm and benzene to one percent, and limits the levels of other toxic chemicals as well.

Conventional alternatives to crude oil-derived fuels such as compressed natural gas, propane and electricity require large investments in automobile modification and fuel delivery infrastructure, not to mention technological development. A need exists for an alternative fuel that provides the combustion properties of motor gasoline without requiring significant engine modification, and that can be stored and delivered like motor gasoline. In order to be an advantageous alternative for gaseous alternative fuels such as methane and propane, liquid alternative fuels should also meet all Environmental Protection Agency (EPA) requirements for "clean fuels."

CGL and NGLs have unsuitably low anti-knock indexes and have thus been under-utilized as alternatives to crude oil as hydrocarbon sources for spark ignition engine motor fuels. Attempts to overcome this deficiency have rendered these hydrocarbon streams unsuitable for use as alternative fuels.

Coal gases have long been recognized because of explosions that have occurred in the course of coal mining. This gas is considered a hazard to operations and has been vented to insure safe operation. However, such venting contributes to the increasing amounts of atmospheric methane, which is a potent greenhouse gas. C. M. Boyer, et al., *U.S. EPA, Air and Radiation* (*ANR*-445) EPA/400/9-90/008. Coal gases can contain significant amounts of heavier hydrocarbons, with $C_{2+}$ fractions as high as 70 percent. Rice, *Hydrocarbons from Coal* (American Association of Petroleum Geologists, Studies in Geology #38, 1993), p. 159.

In contrast to the sourcing of conventional gasoline, over 70 percent of the world reserves of NGLs lie in North America. Imports of NGLs into the United States constitutes less than 10 percent of domestic production. NGLs are recovered from natural gas, gas processing plants, and in some situations, from natural gas field facilities. NGLs extracted by fractionators are also included within the definition of NGLs. NGLs are defined according to the published specifications of the Gas Processors Association and the American Society for Testing and Materials (ASTM). The components of NGLs are classified according to carbon chain length as follows: ethane, propane, n-butane, isobutane and "pentanes plus."

"Pentanes-plus" is defined by the Gas Processors Association and the ASTM as including a mixture of hydrocarbons, mostly pentanes and heavier, extracted from natural gas and including isopentane, natural gasoline, and plant condensates. Pentanes-plus are among the lowest value NGLs. While propanes and butanes are sold to the chemical industry, pentanes-plus are typically diverted to low-added-value oil refinery streams to produce gasoline. Part of the reason why pentanes plus are not generally desirable as gasoline is because they have a low anti-knock index that detracts from its performance as a spark ignition engine motor fuel, as well as a high DVPE which would result in engine vapor lock in warm weather. One advantage of pentanes plus over the other NGLs is that it is liquid at room temperature. Therefore is the only component that can be used in useful quantities as a spark ignition engine motor fuel without significant engine or fuel tank modification.

U.S. Pat. No. 5,004,850 discloses an NGLs-based motor fuel for spark ignition engines in which natural gasoline is blended with toluene to provide a motor fuel with satisfactory anti-knock index and vapor pressure. However, toluene is an expensive, crude oil-derived aromatic hydrocarbon. It's use is severely restricted under the reformulated fuel provision of the 1990 Clean Air Act Amendments.

U.S. Pat. No. 4,806,129 discloses a fuel extender for lead-free gasoline wherein the extender consists essentially of a residue naphtha obtained as a by-product of a basic crude oil refining process, anhydrous ethanol, a stabilizing amount of a water repellant (e.g., ethyl acetate and methyl isobutyl ketone), and aromatics (e.g., benzene, toluene, and xylene). As noted above, however, certain aromatics are undesirable and their use may be restricted by law due to the damaging effects on the environment.

German DE-OS 30 16 481 discloses a fuel additive useful for solubilizing water-containing mixtures of hydrocarbons and alcohols, such as gasoline and methanol. The disclosed additive includes tetrahydrofuran and purportedly may be combined with a mixture of gasoline, methanol, and water to form a stable, clear mixture.

The United States is the world's largest producer of fuel alcohol, with less than ten percent of ethanol imported. Ethanol is a biomass-derived, octane-increasing motor fuel additive. While ethanol alone has a low vapor pressure, when blended alone with hydrocarbons, the resulting mixture has an unacceptably high rate of evaporation to be used in EPA designated ozone non-attainment areas, which include most major metropolitan areas in the United States. The vapor pressure properties of ethanol do not predominate in a blend with pentanes plus until the ethanol level exceeds 60 percent by volume. However, blends containing such a high level of ethanol are costly and difficult to start in cold weather because of the high heat of vaporization of ethanol. Furthermore, ethanol has a low heat content, resulting in low fuel economy compared to gasoline.

Low-cost production of MTHF and the production and use of biomass-derived materials such as ethanol or MTHF as gasoline extenders at levels up to about ten percent by volume is disclosed by Wallington et al., *Environ. Sci. Technol.,* 24, 1596–99 (1990); Rudolph et al., *Biomass* 16, 33–49 (1988); and Lucas et al., *SAE Technical Paper Series, No.* 932675 (1993). Low-cost production of MTHF and its suitability as a low-octane oxygenate for addition to gasoline with or without ethanol to produce an oxygenated motor fuel was disclosed in an unpublished presentation to the Governors'Ethanol Coalition by Stephen W. Fitzpatrick, Ph.D., of Biofine, Inc. on Feb. 16, 1995. Accurate technical data involving the blending DVPE and blending octane values for MTHF were not available. There remains a need for a motor fuel having a DVPE and anti-knock index suitable for use in a spark ignition internal combustion engine without significant modification obtained from non-crude oil sources.

SUMMARY OF THE INVENTION

This need is met by the present invention. Co-solvents for CGL, and for NGLs hydrocarbons such as natural gasoline or pentanes plus, and motor fuel alcohols such as ethanol have been discovered that result in a blend having the requisite DVPE and anti-knock index for use in a conventional spark ignition engine with minor modifications.

Therefore, in accordance with the present invention, a spark ignition motor fuel composition is provided consisting essentially of:

a hydrocarbon component consisting essentially of one or more hydrocarbons selected from four to eight carbon atom straight-chained or branched alkanes, wherein the hydrocarbon component has a minimum anti-knock index of 65 as measured by ASTM D-2699 and D-2700 and a maximum DVPE of 15 psi (one atmosphere (atm.)) as measured by ASTM D-5191;

a fuel grade alcohol; and a co-solvent for the hydrocarbon component and the fuel grade alcohol;

wherein the hydrocarbon component, the fuel grade alcohol and the co-solvent are present in amounts selected to provide a motor fuel with a minimum anti-knock index of 87 as measured by ASTM D-2699 and D-2700, and wherein the fuel composition is essentially free of olefins, aromatics, and sulfur.

Motor fuel compositions in accordance with the present invention may contain n-butane in an amount effective to provide the blend with a DVPE between about 12 (0.8 atm.) and about 15 psi (1 atm.) as measured by ASTM D-5191. The n-butane is preferably obtained from NGLs and CGL.

Another embodiment of the present invention provides a method for lowering the vapor pressure of a hydrocarbon-alcohol blend. Methods in accordance with this embodiment of the present invention blend a motor fuel grade alcohol and a hydrocarbon component with an amount of a co-solvent for the alcohol and the hydrocarbon component so that a ternary blend is obtained having a DVPE as measured by ASTM D-5191 lower than the DVPE for a binary blend of the alcohol and the hydrocarbon component. The hydrocarbon component consists essentially of one or more hydrocarbons selected from the group consisting of four to eight carbon atom straight-chained or branched alkanes. The ternary blend is essentially free of olefins, aromatics, and sulfur.

The co-solvent for the hydrocarbon component and the fuel grade alcohol in both the fuel compositions and methods of the present invention is preferably derived from waste cellulosic biomass materials such as corn husks, corn cobs, straw, oat/rice hulls, sugar cane stocks, low-grade waste paper, paper mill waste sludge, wood wastes, and the like. Co-solvents capable of being derived from waste cellulosic matter include MTHF and other heterocylical ethers such as pyrans and oxepans. MTHF is particularly preferred because it can be produced in high yield at low cost with bulk availability, and possesses the requisite miscibility with hydrocarbons and alcohols, boiling point, flash point and density.

Fuel compositions in accordance with the present invention thus may be derived primarily from renewable, domestically-produced, low cost waste biomass materials such as ethanol and MTHF in combination with hydrocarbon condensates otherwise considered extraction losses of domestic natural gas production such as pentanes plus, and are substantially free of crude oil derivatives. The compositions are clean alternative fuels that contain no olefins, aromatics, heavy hydrocarbons, benzene, sulfur, or any products derived from crude oil. The compositions emit fewer hydrocarbons than gasoline, to help states reduce ozone and meet federal ambient air quality standards. Compositions may be prepared that meet all EPA requirements for "clean fuels," yet at the same time utilize current automobile technology with only minor engine modifications. The compositions require little more than presently existing fuel delivery infrastructure and are based on components that result in a blend that is capable of being competitively priced with gasoline. Other features of the present invention will be pointed out in the following description and claims, which disclose the principles of the invention and the best modes which are presently contemplated for carrying them out.

The above and other features and advantages of the present invention will become clear from the following description of the preferred embodiments considered in conjunction with the accompanying drawings.

DETAILED DESCRIPTION OF THE PREFERRED EMBODIMENT

The compositions of the present invention are virtually free of undesirable olefins, aromatics, heavy hydrocarbons, benzene and sulfur, making the fuel compositions very clean burning. The fuel compositions of the present invention may be utilized to fuel conventional spark-ignition internal combustion engines with minor modification. The primary requirement is the lowering of the air/fuel ratio to between about 12 and about 13, as opposed to 14.6, typical of gasoline fueled engines. This adjustment is necessary because of the large quantity of oxygen that is already contained in the fuel.

This adjustment can be accomplished in vehicles manufactured in 1996 and thereafter by software modifications to the on-board engine computer. For older cars, it will be necessary to replace a chip in the on-board engine computer or, in some cases, to replace the on-board engine computer entirely. Carbureted vehicles, on the other hand, can be readily adjusted to the appropriate air/fuel ratio, and at most will require a simple orifice replacement. Vehicles fueled by the compositions of the present invention preferably should be adapted to run on ethanol or methanol by having fuel system components installed that are compatible with ethanol and methanol, and do not have parts in contact with the fuel made from ethanol and methanol sensitive materials such as nitrile rubber, and the like.

The Clean Air Act Amendments of 1990 set maximum values for both olefins and aromatics, because they result in emission of unburned hydrocarbons. A maximum of 24.6 percent by volume of aromatics may be present in the winter, and 32.0 percent by volume in the summer. A maximum of 11.9 percent by volume of olefins may be present in the winter, and a maximum of 9.2 percent by volume in the summer. Benzene must be present at a level less than or equal to 1.0 percent by volume, and the maximum permitted sulfur is 338 ppm. The fuel compositions of the present invention are essentially free of such materials.

Motor fuel compositions according to the invention are produced by blending one or more hydrocarbons with a fuel grade alcohol selected from methanol, ethanol and mixtures thereof and a co-solvent for the one or more hydrocarbons and the fuel grade alcohol. The fuel grade alcohol is added to increase the anti-knock index of the hydrocarbon component. The co-solvents of the present invention make it possible to add to the motor fuel compositions significant quantities of alcohol effective to provide an acceptable combination of anti-knock index and DVPE. Suitable fuel grade alcohols can be readily identified and obtained for use in the present invention by one of ordinary skill in the art.

Other anti-knock index increasing additives may be used as well, including those additives, such as toluene, derived from crude oil. However, preferred compositions in accordance with the present invention will be substantially free of crude oil derivatives, including crude oil-derived additives for increasing the anti-knock index.

Essentially any hydrocarbon source containing one or more five to eight carbon atom straight-chained or branched alkanes is suitable for use with the present invention if the hydrocarbon source, as a whole, has a minimum anti-knock index of 65 as measured by ASTM D-2699 and D-2700 and a maximum DVPE of 15 psi (1 atm.) as measured by ASTM D-5191. Those of ordinary skill in the art understand the term "anti-knock index" to refer to the average of the Research Octane Number ("RON" is "R") as measured by ASTM D-2699 and the Motor Octane Number ("MON" is "M") as measured by ASTM D-2700. This is commonly expressed as (R+M)/2.

The hydrocarbon component is preferably derived from CGL or NGLs, and is more preferably the NGLs fraction defined by the Gas Processors Association and the ASTM as "pentanes plus," which is a commercially available commodity. However, any other hydrocarbon blend having an equivalent energy content, oxygen content and combustion properties may also be used. For example, the fraction of NGLs defined by the Gas Processors Association and the ASTM as "natural gasoline" can be blended with isopentane and substituted for pentanes plus. Natural gasoline alone may be used, as well. In most circumstances, the preparation of blends instead of using "straight" pentanes plus or natural gasoline will be more costly. While any other equivalent blend may be used, similar cost considerations apply.

The hydrocarbon component is blended with the fuel grade alcohol using a co-solvent selected to provide a blend with a DVPE below 15 psi (1 atm.) without a sacrifice in the anti-knock index or flash point of the resulting blend, so that a motor fuel composition is obtained suitable for use in a spark ignition engine with minor modifications. Co-solvents suitable for use with the present invention are miscible in both the hydrocarbons and the fuel grade alcohol and have a boiling point high enough to provide a DVPE less than 15 psi (1 atm.) in the final blend, preferably greater than 75° C. The co-solvent should have a flash point low enough to ensure cold starting of the final blend, preferably less than −10° C. The co-solvent should also have at least an 85° C. difference between the boiling point and flash point and a specific gravity greater than 0.78.

Five to seven atom heterocyclic ring compounds are preferred as the co-solvent. The heteroatomic polar ring structure is compatible with fuel grade alcohols, yet possesses non-polar regions compatible with hydrocarbons. The heteroatomic structure also functions to depress the vapor pressure of the co-solvent and consequently the resulting blend. The same advantageous properties can also be obtained from short-chained ethers; however, ring compounds are preferred.

Saturated alkyl-branched heterocyclic compounds with a single oxygen atom in the ring are preferred, because the alkyl branching further depresses the vapor pressure of the co-solvent. The ring compound may contain multiple alkyl branches however, a single branch is preferred. MTHF is an example of a five-membered heterocyclic ring with one methyl branch adjacent to the oxygen atom in the ring.

While nitrogen containing ring compounds are included among the co-solvents of the present invention, they are less preferred because the nitrogen heteroatoms form oxides of nitrogen combustion products, which are pollutants. Thus, oxygen-containing heterocyclic ring compounds are preferred over rings with nitrogen heteroatoms, with alkylated ring compounds being more preferred. In addition, the ring oxygen also functions as an oxygenate that promotes cleaner burning of the motor fuel compositions of the present invention. Thus, oxygen-containing heterocyclic ring compounds are particularly preferred co-solvents in the motor fuel compositions of the present invention because of their ability as oxygenates to provide a cleaner burning fuel composition which is in addition to their being a vapor pressure-lowering co-solvent for hydrocarbons and fuel grade alcohols.

Accordingly, oxygen-containing saturated five- to seven atom heterocyclic rings are most preferred. MTHF is particularly preferred. While MTHF is considered an octane depressant for gasoline, it improves the octane rating of NGLs. Not only does MTHF have superior miscibility with hydrocarbons and alcohols and a desirable boiling point, flash point and density, MTHF is a readily available, inexpensive, bulk commodity item. MTHF also has a higher heat content than fuel grade alcohols and does not pick up water as alcohols do, and is thus fungible in an oil pipeline. This permits larger quantities of the fuel grade alcohols to be used to increase the anti-knock index of the motor fuel compositions.

In addition, MTHF is commercially derived from the production of levulenic acid from waste cellulosic biomass such as corn husks, corn cobs, straw, oat/rice hulls, sugar cane stocks, low-grade waste paper, paper mill waste sludge, wood wastes, and the like. The production of MTHF from such cellulosic waste products is disclosed in U.S. Pat. No.

4,897,497. MTHF that has been produced from waste cellulosic biomass is particularly preferred as a co-solvent in the motor fuel compositions of the present invention. Examples of other suitable co-solvents, selected on the basis of boiling point, flash point, density and miscibility with fuel grade alcohols and pentanes plus, are 2-methyl-2-propanol, 3-butene-2-one, tetrahydropyran, 2-ethyltetra-hydrofuran (ETHF), 3,4-dihydro-2H-pyran, 3,3-dimethyloxetane, 2-methylbutyraldehyde, butylethyl ether, 3-methyltetrahydropyran, 4-methyl-2-pentanone, diallyl ether, allyl propyl ether, and the like. As is readily apparent from the above list, short-chained ethers function as well as heterocyclic ring compounds with respect to miscibility with hydrocarbons and fuel grade alcohols and vapor pressure depression of the resulting motor fuel composition. Like the oxygen-containing heterocyclic ring compounds, short-chained ethers are also ideally vapor pressure-lowering oxygenates.

The motor fuel compositions of the present invention optionally include n-butane in an amount effective to provide a DVPE between about seven (0.5 atm.) and about 15 psi (1 atm.). However, the compositions may be formulated to provide a DVPE as low as 3.5 psi (0.2 atm.). The higher DVPE is desirable in the northern United States and Europe during winter to promote cold weather starting. Preferably, the n-butane is obtained from NGLs or CGL.

The motor fuel compositions also optionally include conventional additives for spark ignition motor fuels. Thus, the motor fuel compositions of the present invention may include conventional amounts of detergent, anti-foaming, and anti-icing additives and the like. The additives may be derived from crude oil; however, preferred compositions in accordance with the present invention are substantially free of crude oil derivatives.

The motor fuel compositions of the present invention are prepared using conventional rack-blending techniques for ethanol-containing motor fuels. Preferably, to prevent evaporative loss emissions, the dense co-solvent component is first pumped cold (less than 70° F. (21° C.)) through a port in the bottom of a blending tank. The hydrocarbons are then pumped without agitating through the same port in the bottom of the tank to minimize evaporative loss. If used, n-butane is pumped cold (less than 40° F. (4° C.)) through the bottom of the tank. The butane is pumped next through the bottom port, so it is immediately diluted so that surface vapor pressure is minimized to prevent evaporative losses. Alternatively, two or more of the MTHF, hydrocarbons and n-butane, if used, may be pumped through the bottom port together. If not blended at the distribution rack, the two or three components may be obtained as a blend through conventional gasoline pipelines. Because ethanol alone would otherwise raise the vapor pressure of the hydrocarbons and promote evaporative loss, the ethanol is preferably blended last, after the MTHF and n-butane, if present, has already blended with the hydrocarbon, by conventional splash blending techniques for the introduction of ethanol to motor fuels.

Thus, for a blend containing n-butane, ethanol, MTHF and pentanes plus, the MTHF is first pumped into the blending tank. Without agitation, pentanes-plus is pumped through the bottom of the tank into the MTHF, followed by the n-butane (if used). Finally, ethanol is blended through the bottom. The blend is then recovered and stored by conventional means.

The hydrocarbons, fuel grade alcohol and co-solvent are added in amounts selected to provide a motor fuel composition with a minimum anti-knock index of 87 as measured by ASTM D-2699 and D-2700 and a maximum DVPE of 15 psi (1 atm.) as measured by ASTM D-5191. A minimum anti-knock index of 89.0 is preferred, and a minimum anti-knock index of 92.5 is even more preferred. In the summer, a maximum DVPE of 8.1 psi (0.55 atm.) is preferred, with a maximum DVPE of 7.2 psi (0.5 atm.) being more preferred. In the winter, the DVPE should be as close as possible to 15 psi (1 atm), preferably between about 12 psi(0.8 atm.) and about 15 psi (1 atm.). For this reason, n-butane may be added to the motor fuel compositions of the present invention in an amount effective to provide a DVPE within this range.

In preferred motor fuel compositions in accordance with the present invention, the hydrocarbon component consists essentially of one or more hydrocarbons obtained from NGLs, blended with ethanol, MTHF and, optionally, n-butane. The NGLs hydrocarbons may be present at a level between about ten and about 50 percent by volume, the ethanol may be present in an amount between about 25 and about 55 percent by volume, the MTHF may be present in an amount between about 15 and about 55 percent by volume, and the n-butane may be present in a level between zero and about 15 percent by volume. More preferred motor fuel compositions contain from about 25 to about 40 percent by volume of pentanes plus, from about 25 to about 40 percent by volume of ethanol, from about 20 to about 30 percent by volume of MTHF and from zero to about ten percent by volume of n-butane.

The compositions of the present invention may be formulated as summer and winter fuel blends having T10 and T90 values as measured by ASTM-D86 within ASTM specifications for summer and winter fuel blends. The winter blend compositions of the present invention are significantly more volatile than conventional gasoline to aid cold weather starting. The T90 values indicate the amount of "heavy-end" components in the fuel. These substances are considered to be a primary source of unburned hydrocarbons during the cold start phase of engine operation. The lower values of "heavy-end" components in the compositions of the present invention also indicates superior emissions performance. The amount of solid residue after combustion is only one-fifth that typically found in conventional gasoline.

A particularly preferred summer fuel blend contains about 32.5 percent by volume of pentanes plus, about 35 percent by volume of ethanol, and about 32.5 percent by volume of MTHF. This blend is characterized as follows:

| Test | Method | Result | Conditions |
|---|---|---|---|
| API Gravity | ASTM D4052 | 52.1 | 60° F. (15.6° C.) |
| Distillation | ASTM D86 | | |
| Initial Boiling Point | | 107.0° F. (41.7° C.) | |
| T10 | | 133.2° F. (56.2° C.) | |

-continued

| Test | Method | Result | Conditions |
|---|---|---|---|
| T50 | | 161.8° F. (72.1° C.) | |
| T90 | | 166.9° F. (74.9° C.) | |
| Final Boiling Point | | 195.5° F. (90.8° C.) | |
| Recovered | | 99.5 wt. % | |
| Residue | | 0.3 wt. % | |
| Loss | | 0.2 wt. % | |
| DVPE | ASTM D5191 | 8.10 psi (0.5 atm.) | |
| Lead | ASTM D3237 | <0.01 g/gal ($<2.64 \times 10^{-3}$ g/l) | |
| Research Octane No. | ASTM D2699 | 96.8 | |
| Motor Octane No. | ASTM D2700 | 82.6 | |
| (R + M)/2 (Anti-Knock Index) | ASTM D4814 | 89.7 | |
| Copper Corrosion | ASTM D130 | 1 A | 3 hrs. @ 122° F. (50° C.) |
| Gum (After Wash) | ASTM D381 | 2.2 mg/100 mL | |
| Sulfur | ASTM D2622 | 3.0 ppm | |
| Phosphorous | ASTM D3231 | <0.004 g/gal ($<1.05 \times 10^{-3}$ g/l) | |
| Oxidation Stability | ASTM D525 | 165 min | |
| Oxygenates | ASTM D4815 | | |
| Ethanol | | 34.87 vol % | |
| Oxygen | ASTM D4815 | 18.92 wt. % | |
| Benzene | ASTM D3606 | 0.15 vol % | |
| V/L 20 | CALCULATED | 135° F. (57.2° C.) | |
| Doctor Test | ASTM D4952 | POSITIVE | |
| Aromatics | ASTM D1319 | .41 vol % | |
| Olefins | ASTM D1319 | 0.09 vol % | |
| Mercaptan Sulfur | ASTM D3227 | .0010 wt. % | |
| Water Tolerance | ASTM D4814 | <−65° C. | |
| Heat Content | ASTM D3338 | 18,663 BTU/lb (43,410 kilojoules/kilogram) | |

A particularly preferred winter fuel blend contains about 40 percent by volume of pentanes plus, about 25 percent by volume of ethanol, about 25 percent by volume of MTHF and about 10 percent by volume of n-butane. This blend is characterized as follows:

| Test | Method | Result | Conditions |
|---|---|---|---|
| API Gravity | ASTM D4052 | 59.0 | 60° F. (15.6° C.) |
| Distillation | ASTM D86 | | |
| Initial Boiling Point | | 83.7° F. (28.7° C.) | |
| T10 | | 102.7° F. (39.3° C.) | |
| T50 | | 154.1° F. (67.8° C.) | |
| T90 | | 166.5° F. (74.7° C.) | |
| Final Boiling Point | | 235.6° F. (113.1° C.) | |
| Recovered | | 97.1 wt. % | |
| Residue | | 1.2 wt. % | |
| Loss | | 2.9 wt. % | |
| DVPE | ASTM D5191 | 14.69 psi(1 atm.) | |
| Lead | ASTM D3237 | <0.01 g/gal ($<2.64 \times 10^{-3}$ g/l) | |
| Research Octane No. | ASTM D2699 | 93.5 | |
| Motor Octane No. | ASTM D2700 | 84.4 | |
| (R + M)/2 (Anti-Knock Index) | ASTM D4814 | 89.0 | |
| Copper Corrosion | ASTM D130 | 1 A | 3 hrs. @ 122° F. (50° C.) |
| Gum (After Wash) | ASIM D381 | <1 mg/100 mL | |
| Sulfur | ASTM D2622 | 123 ppm | |
| Phosphorous | ASTM D3231 | <0.004 g/gal ($<1.05 \times 10^{-3}$ g/l) | |
| Oxidation Stability | ASTM D525 | 105 min | |
| Oxygenates | ASTM D4815 | | |
| Ethanol | | 25.0 vol % | |
| Oxygen | ASTM D4815 | 9.28 wt. % | |
| Benzene | ASTM D3606 | 0.18 vol % | |
| V/L 20 | CALCULATED | 101° F. | |
| Doctor Test | ASTM D4952 | POSITIVE | |
| Aromatics | ASTM D1319 | 0.51 vol % | |
| Olefins | ASTM D1319 | 2.6 vol % | |

-continued

| Test | Method | Result | Conditions |
|---|---|---|---|
| Mercaptan Sulfur | ASTM D3227 | | |
| Water Tolerance | ASTM D4814 | <−65° C. | |
| Heat Content | ASTM D3338 | 18,776 BTU/lb (43,673 kilojoules/kilogram) | |

A preferred summer premium blend contains about 27.5 percent by volume of pentanes plus, about 55 percent by volume of ethanol and about 17.5 percent by volume of MTHF. The blend is characterized as follows:

| Test | Method | Result | Conditions |
|---|---|---|---|
| API Gravity | ASTM D4052 | 58.9 | 60° F. (15.6° C.) |
| Distillation | ASTM D86 | | |
| Initial Boiling Point | | 103.5° F. (39.7° C.) | |
| T10 | | 128.2° F. (54.4° C.) | |
| T50 | | 163.7° F. (73.2° C.) | |
| T90 | | 169.8° F. (76.6° C.) | |
| Final Boiling Point | | 175.0° F. (79.4° C.) | |
| Recovered | | 99.0 wt. % | |
| Residue | | 0.6 wt. % | |
| Loss | | 0.4 wt. % | |
| DVPE | ASTM D5191 | 8.05 psi (0.5 atm.) | |
| Lead | ASTM D3237 | <0.01 g/gal ($<2.64 \times 10^{-3}$ g/l) | |
| Research Octane No. | ASTM D2699 | 100.5 | |
| Motor Octane No. | ASTM D2700 | 85.4 | |
| (R + M)/2 (Anti-Knock Index) | ASTM D4814 | 93.0 | |
| Copper Corrosion | ASTM D130 | 1 A | 3 hrs. @ 122° F. (50° C.) |
| Gum (After Wash) | ASTM D381 | 1.6 mg/100 mL | |
| Sulfur | ASTM D2622 | 24 ppm | |
| Phosphorous | ASTM D3231 | <0.004 g/gal ($<1.05 \times 10^{-3}$ g/l) | |
| Oxidation Stability | ASTM D525 | 150 min | |
| Oxygenates | ASTM D4815 | | |
| Ethanol | | 54.96 vol % | |
| Oxygen | ASTM D4815 | 19.98 wt. % | |
| Benzene | ASTM D3606 | 0.22 vol % | |
| V/L 20 | CALCULATED | 126° F. (52.2° C.) | |
| Doctor Test | ASTM D4952 | POSITIVE | |
| Aromatics | ASTM D1319 | 0.20 vol % | |
| Olefins | ASTM D1319 | 0.15 vol % | |
| Mercaptan Sulfur | ASTM D3227 | .0008 wt. % | |
| Water Tolerance | ASTM D4814 | <−65° C. | |
| Heat Content | ASTM D3338 | 18,793 BTU/lb (43,713 kilojoules/kilogram) | |

A preferred winter premium blend contains about 16 percent by volume of pentanes plus, about 47 percent by volume of ethanol, about 26 percent by volume of MTHF and about 11 percent by volume of n-butane. The blend is characterized as follows:

| Test | Method | Result | Conditions |
|---|---|---|---|
| API Gravity | ASTM D4052 | 51.6 | 60° F. (15.6° C.) |
| Distillation | ASTM D86 | | |
| Initial Boiling Point | | 83.7° F. (28.7° C.) | |
| T10 | | 109.7° F. (43.2° C.) | |
| T50 | | 165.2° F. (74.0° C.) | |
| T90 | | 168.7° F. (75.9° C.) | |

-continued

| Test | Method | Result | Conditions |
|---|---|---|---|
| Final Boiling Point | | 173.4° F. (78.5° C.) | |
| Recovered | | 97.9 wt. % | |
| Residue | | | |
| Loss | | 2.1 wt. % | |
| DVPE | ASTM D5191 | 14.61 psi(1 atm.) | |
| Lead | ASTM D3237 | <0.01 g/gal ($<2.64 \times 10^{-3}$ g/l) | |
| Research Octane No. | ASTM D2699 | 101.2 | |
| Motor Octane No. | ASTM D2700 | 85.4 | |
| (R + M)/2 (Anti-Knock Index) | ASTM D4814 | 93.3 | |
| Copper Corrosion | ASTM D130 | 1 A | 3 hrs. @ 122° F. (50° C.) |
| Gum (After Wash) | ASTM D381 | 1 mg/100 mL | |
| Sulfur | ASTM D2622 | 111 ppm | |
| Phosphorous | ASTM D3231 | <0.004 g/gal ($<1.05 \times 10^{-3}$ g/l) | |
| Oxidation Stability | ASTM D525 | 210 min | |
| Oxygenates | ASTM D4815 | | |
| Ethanol | | 47.0 vol % | |
| Oxygen | ASTM D4815 | 16.77 wt. % | |
| Benzene | ASTM D3606 | 0.04 vol % | |
| V/L 20 | CALCULATED | | |
| Doctor Test | ASTM D4952 | POSITIVE | |
| Aromatics | GC-MSD | 0.17 vol % | |
| Olefins | ASTM D1319 | 0.85 vol % | |
| Mercaptan Sulfur | ASTM D3227 | | |
| Water Tolerance | ASTM D4814 | <−65° C. | |
| Heat Content | ASTM D3338 | 18,673 BTU/lb (43,433 kilojoules/kilogram) | |

Thus, it will be appreciated that the present invention provides a motor gasoline alternative essentially free of crude oil products that can fuel a spark ignition internal combustion engine with minor modifications, yet can be blended to limit emissions resulting from evaporative losses. The present invention provides fuel compositions containing less than 0.1 percent benzene, less than 0.5 percent aromatics, less than 0.1 percent olefins and less than ten ppm sulfur. The following examples further illustrate the present invention, and are not to be construed as limiting the scope thereof. All parts and percentages are by volume unless expressly indicated to be otherwise and all temperatures are in degrees Fahrenheit.

EXAMPLES

Example 1

A fuel composition in accordance with the present invention was prepared by blending 40 percent by volume of natural gasoline procured from Daylight Engineering, Elberfield, Ind., 40 percent by volume of 200 proof ethanol procured from Pharmco Products, Inc., Brookfield, Conn., and 20 percent by volume of MTHF purchased from the Quaker Oats Chemical Company, West Lafayette, Ind. Two liters of ethanol was pre-blended with one liter of MTHF in order to avoid evaporative loss of the ethanol upon contact with the natural gasoline. The ethanol and MTHF were cooled to 40° F. (44° C.) prior to blending to further minimize evaporative losses.

Two liters of the natural gasoline were added to a mixing tank. The natural gasoline was also cooled to 40° F. (44° C.) to minimize evaporative losses. The blend of ethanol and MTHF was then added to the natural gasoline with mixing. The mixture was gently stirred for five seconds until a uniform, homogeneous blend was obtained.

The content of the natural gasoline was analyzed by Inchcape Testing Services (Caleb-Brett) of Linden, N.J. It was found to consist of the following components:

| | |
|---|---|
| Butane | Not Found |
| Isopentane | 33 Vol. % |
| n-Pentane | 21 Vol. % |
| Isohexane | 26 Vol. % |
| n-Hexane | 11 Vol. % |
| Isoheptane | 6 Vol. % |
| n-Heptane | 2 Vol. % |
| Benzene | <1 Vol. % |
| Toluene | <0.5 Vol. % |

Thus, while Daylight Engineering refers to this product as "natural gasoline," the product conforms to the Gas Processor's Association's definition of pentanes plus, as well as the definition of pentanes plus for purposes of the present invention.

The motor fuel was tested on a 1984 Chevrolet Caprice Classic with a 350 CID V-8 engine and a four barrel carburetor (VIN 1 GI AN 69H4 EX 149195). A carbureted engine was chosen so that adjustment of the idle fuel mixture was possible without electronic intervention. There was a degree of electronic fuel management in that the oxygen content in the exhaust, manifold air pressure, throttle position and coolant temperature were measured. Pollution tests were performed at two throttle positions, fast-idle (1950 rpm) and slow-idle (720 rpm). THC (total hydrocarbons), CO (carbon monoxide), $O_2$ and $CO_2$ exhaust emissions were recorded with a wand-type four-gas analyzer.

The engine was examined and a broken vacuum line was replaced. The idle-speed and spark timing were adjusted to manufacturer's specifications. The ignition "spark line" appeared to be even, indicating no undue problem with any of the spark plugs or wires. The manifold vacuum was between 20 inches (51 cm) and 21 inches (53 cm) and steady, indicating no difficulties with the piston rings or intake and exhaust valves.

At the time this test was performed in the New York Metropolitan area, conventional gasoline was not available at retail. Therefore, the comparison was not made with a "base line gasoline" as defined in the Clean Air Act, but with a fuel already formulated to burn more cleanly. The emissions tests performed on the above fuel composition were compared to SUNOCO 87-octane reformulated gasoline purchased at a retail service station. Tests were performed on the same engine, on the same day, and within one hour of each other. The three tests included: (1) fast and slow idle emissions tests for total hydrocarbons (THC) and carbon monoxide (CO), (2) fast-idle fuel consumption, and (3) 2.7 mile (4.3 kilometers) road test for fuel economy and driveability. The summary of the emissions tests is shown in the following table:

| Time of Day | Idle Speed (rpm) | Fuel | THC (ppm) | CO (%) |
|---|---|---|---|---|
| 09:46 | 720 | Sunoco-87 | 132 | 0.38 |
| 09:54 | 720 | Sunoco-87 | 101 | 0.27 |
| 09:55 | 1950 | Sunoco-87 | 132 | 0.61 |
| 10:42 | 700 | NGLs/ethanol | 76 | 0.03 |
| 10:44 | 720 | NGLS/ethanol | 65 | 0.02 |
| 10:48 | 1900 | NGLs/ethanol | 98 | 0.01 |

It should be noted that the New Jersey state emissions requirements for model years 1981 to the present are THC<220 ppm and CO<1.2 percent.

The engines were operated at fast idle (1970 rpm) for approximately seven minutes. Fuel consumption for the above fuel composition was 650 mL in six minutes and 30 seconds (100 mL per minute). The fuel consumption for the reformulated gasoline was 600 mL in seven minutes (86 mL per minute). The 2.7 mile (4.3 kilometers) on-road test showed no significant difference in fuel consumption (900 mL for the above fuel composition and 870 mL for the reformulated gasoline).

Compared with the reformulated gasoline, the above fuel composition reduced CO emissions by a factor of 10, and THC emissions decreased by 43 percent. In the fast-idle test, the consumption of the above fuel composition was 14 percent greater than the reformulated gasoline. No significant difference in driveability was noticed during the on-road test. During full-throttle acceleration, engine knock was slightly more noticeable with the reformulated gasoline.

Thus, it will be appreciated that the fuel compositions of the present invention can be used to fuel spark-ignited internal combustion engines. The CO and THC emission properties are better than gasoline reformulated to burn cleaner than baseline gasoline, with no significant difference in fuel consumption.

Example 2

A summer fuel blend was prepared as in Example 1, containing 32.5 percent by volume of natural gasoline (Daylight Engineering), 35 percent by volume of ethanol and 32.5 percent by volume of MTHF. A winter fuel blend was prepared as in Example 1, containing 40 percent by volume of pentanes plus, 25 percent by volume of ethanol, 25 percent by volume of MTHF and ten percent by volume of n-butane. The motor fuels were tested along with $E_D85$ (E85), a prior art alternative fuel containing 80 percent by volume of 200 proof pure ethyl alcohol and 20 percent by volume of indolene, an EPA certification test fuel defined in 40 C.F.R. § 86 and obtained from Sunoco of Marcus Hook, Pa. The E85 was prepared according to the method disclosed in Example 1. The three fuels were tested against indolene as a control on a 1996 Ford Taurus GL sedan ethanol Flexible Fuel Vehicle (VIN 1FALT522X5G195580) with a fully warmed-up engine. Emissions testing was performed at Compliance and Research Services, Inc. of Linden, N.J.

The vehicle was loaded on a Clayton Industries, Inc., Model ECE-50 (split roll) dynamometer. The dynamometer was set for an inertial test weight of 3,750 lbs. (1,700 kilograms). The exhaust gases were sampled with a Horiba Instruments, Inc. Model CVS-40 gas analyzer. Hydrocarbons (THC) were analyzed with a Horiba Model FIA-23A Flame Ionization Detector (FID). Carbon Monoxide (CO) and Carbon Dioxide ($CO_2$) were analyzed with a Horiba Model AIA-23 Non-Dispersive Infrared Detector (NDIR). Hydrocarbon speciation was performed on a Gas Chromatograph with a FID manufactured by Perkin Elmer Inc. The GC column was a Supelco 100 M×0.25 mm×0.50 micron Petrocol DH. All emissions testing equipment was manufactured in 1984.

The summary of emissions sampled directly from the exhaust manifold (before the catalytic converter) are shown in the following table as the percentage reduction of THC and CO for each fuel blend relative to indolene:

| Engine Speed | MPH (km/hr) | THC (Winter) | CO (Winter) | THC (Summer) | CO (Summer) | TCH (E85) | CO (E85) |
|---|---|---|---|---|---|---|---|
| 1500 | 30 (48) | −27 ± 23 | n.s. | −45 ± 25 | n.s. | −42 ± 23 | n.s. |
| 2000 | 41 (66) | −35 ± 23 | n.s. | −47 ± 31 | n.s. | −45 ± 29 | n.s. |
| 2500 | 51 (82) | −37 ± 10 | n.s. | −53 ± 11 | n.s. | −43 ± 11 | n.s. |
| 3000 | 61 (98) | −65 ± 18 | −71 ± 18 | −68 ± 14 | −73 ± 13 | −50 ± 20 | −48 ± 23 |
| 3500 | 67 (107) | −71 ± 21 | −71 ± 46 | −74 ± 21 | −76 ± 47 | −54 ± 18 | −46 ± 41 |

n.s. = no significant variation

The fuel compositions burned essentially the same as indolene at lower engine rpm, but significantly better at rpms of 2500 and greater. In most cases the fuels burned as clean as or cleaner than E85.

The essential feature of the Ford Taurus Flexible Fuel Vehicle was its ability to choose the proper air/fuel ratio for any mixture of fuels used. The vehicle was not modified externally in any way between tests. The Electronic Emissions Computer and fuel sensor showed that the selected air/fuel ratio was as follows:

| | |
|---|---|
| indolene | 14.6 |
| winter blend | 12.5 |
| summer blend | 11.9 |
| E85 | 10.4 |

The foregoing examples and description of the preferred embodiment should be taken as illustrating, rather than as limiting, the present invention as defined by the claims. As will be readily appreciated, numerous variations and combinations of the features set forth above can be utilized without departing from the present invention as set forth in the claims. All such modifications are intended to be included within the scope of the following claims.

What is claimed is:

1. A spark ignition motor fuel composition consisting essentially of:

a hydrocarbon component consisting essentially of one or more hydrocarbons selected from the group consisting of four to eight carbon atom straight-chained or branched alkanes, wherein said hydrocarbon component has a minimum anti-knock index of 65 as measured by American Society for Testing and Materials (ASTM) D-2699 and D-2700 and a maximum dry vapor pressure equivalent (DVPE) of 15 psi (one atmosphere) as measured by ASTM D-5191;

a fuel grade alcohol; and a co-solvent miscible in both said hydrocarbon component and said fuel grade alcohol;

wherein said co-solvent is selected from a group consisting of 2-ehyletrahydrofuran (ETHF)and 2-methyletrahydrofuran (MTHF) wherein said hydrocarbon component, said fuel grade alcohol and said co-solvent are present in amounts effective to provide a fuel with a minimum and knock index of 87 as measured by ASTM D-2699 and ASTM D-2700, and wherein said fuel composition is essentially free of olefins, aromatics, and sulfur.

2. The spark ignition motor fuel composition of claim 1, wherein said hydrocarbon component consists essentially of one or more hydrocarbons selected from Natural Gas Liquids hydrocarbons.

3. The spark ignition motor fuel composition of claim 2, wherein said hydrocarbon component of consists essentially of natural gasoline.

4. The spark ignition motor fuel composition of claim 2, wherein said hydrocarbon component consists essentially of pentanes plus.

5. The spark ignition motor fuel compostition of claim 1, wherein said hydrocarbon component consists essentially of one or more hydrocarbons selected from Coal Gas Liquid hydrocarbons.

6. The spark ignition motor fuel composition of claim 1, wherein said hydrocarbon component includes n-butane and said hydrocarbon component, said fuel grade alcohol, and said co-solvent are present in amounts effective to provide a DVPE between about 12 psi. (0.8atm.) and about 15 psi (1atm.).

7. The spark ignition motor fuel composition of claim 1, wherein said fuel grade alcohol is selected from the group consisting of methanol, ethanol, and mixtures thereof.

8. The motor fuel compsition of claim 1, wherein said hydrocarbon component consists essentially of one or more hydrocarbons selected from Natural Gas Liquid hydrocarbons, said fuel grade alcohol comprises ethanol, and said co-solvent is MTHF.

9. The motor fuel composition of claim 1, having a minimum anti-knock index of 89.0.

10. The motor fuel composition of claim 1, having a maximum DVPE of 8.3 psi (0.5 atm.).

11. A spark ignition motor fuel composition consisting essentially of;

a hydrocarbon component consisting essentially of one or more hydrocarbon selected from the group consisting of four to eight carbon atom straight-chained or branched alkanes, wherein said hydrocarbon component has a minimum and-knock index of 65 as measured by ASTM D-2699 and D-2700 and a maximum DVPE of 15 psi (one atmosphere) as measured by ASTM D-5191;

ethanol; and a co-solvent miscrible in both said hydrocarbon component and said ehtanol;

wherein said co-solvent is selected from a group consisting of 2-ethyltetrahydrofuran (ETHF) and 2-methyletrahydrofuran (MTHF), wherein said hydrocarbon component, said ethanol and said co-solvent are present in amounts effective to provide a motor fuel with a minimum anti-knock index of 87 as measured by ASTM D-2699 and ASTM D-2700, and wherein said fuel composition is essentially free of olefins, aromatics, and sulfur.

12. The fuel composition of claim 11, wherein said hydrocarbon component consists essentially of one or more hydrocarbons selected from Natural Gas Liquid hydrocarbons.

* * * * *